US006375144B1

(12) United States Patent
Lacey

(10) Patent No.: US 6,375,144 B1
(45) Date of Patent: Apr. 23, 2002

(54) EASEL FOR MATTRESS DEMONSTRATION BAG

(75) Inventor: Charles Lacey, Wayne, PA (US)

(73) Assignee: Horizon Displays, Inc., Wayne, PA (US)

( * ) Notice: Subject to any disclaimer, the term of this patent is extended or adjusted under 35 U.S.C. 154(b) by 0 days.

(21) Appl. No.: 09/651,445

(22) Filed: Aug. 30, 2000

(51) Int. Cl.[7] ..... A47B 5/04
(52) U.S. Cl. ..... 248/441.1; 5/503.1; 248/455
(58) Field of Search ..... 248/441.1, 447, 248/450, 454, 455, 457; 5/503.1

(56) References Cited

U.S. PATENT DOCUMENTS 2,784,423 A * 3/1957 Droeger et al. ..... 5/503.1
5,581,829 A * 12/1996 Lee ..... 5/503.1
5,605,235 A * 2/1997 Johnson ..... 5/503.1
5,758,972 A * 6/1998 Mack et al. ..... 248/205.2

* cited by examiner

*Primary Examiner*—Ramon O. Ramirez
(74) *Attorney, Agent, or Firm*—Paul & Paul

(57) ABSTRACT

An easel for supporting and stabilizing a mattress demonstration bag, for use in mattress/bedding showrooms, wherein said easel comprises a housing, a base, and supporting means. The housing comprises an envelope, which encapsulates the supporting means. The supporting means is a relatively flexible support board such as cloth or vinyl, or alternatively, a relatively rigid support board such as cardboard, Styrofoam, wood, or plastic. The base is a flexible, collapsible ribbon, which is attached to the mattress support bag by a Velcro pad. The easel can support the mattress demonstration bag between angles of 0° and 90°, wherein the maximum angle of support is 60° while the base is attached to the mattress demonstration bag. In this position, the easel allows for support of the bag in a generally upright position. When the base is detached from the bag, then the maximum angle of support is 90°, and in this position, the easel becomes a cantilever support, and slidably mounts in between a mattress and a box spring.

15 Claims, 5 Drawing Sheets

EASEL FOR MATTRESS DEMONSTRATION BAG

BACKGROUND OF THE INVENTION

1. Field of Invention

The present invention relates to the field of easels, and more particularly, to a collapsible easel for mounting on and supporting a mattress demonstration bag, wherein the easel is capable of angles of support ranging from 0° to 90°.

2. Brief Description of the Prior Art

Easels are generally used to provide support for photo or picture frames or the like. They are also used for displaying various objects; most notably artists' easels are used for displaying works of art and other artistic objects displayed to grab the attention of passersby. Easels have also been used to display non-artistic works, and as such may be used for displaying articles of manufacture such as mattress samples.

Mattress samples are often secured in a transparent bag, such that the general make-up, including the thickness and design, of the mattress can be viewed and inspected by customers, and can be used by salespersons to more fully explain the attributes of a given type of mattress. Moreover, such bags are used for advertising purposes to lure potential customers into purchasing a particular brand or style of mattress. Furthermore, the bags allow mattress producers to display their products on a smaller scale to readily show differences in styles and designs.

The mattress demonstration bags are strategically placed on top of mattresses and beds displayed for sale in mattress/bedding showrooms. The bags are often propped up against the bed's headboard, footboard, or against a pillow placed on the bed for demonstration purposes. Sometimes the bags are simply placed flat on the top of the mattresses. Other times, the bags are simply propped up against the side of the mattress/bed on display, on or near the floor. Such placements of these transparent bags are not always ideal, as customers can simply overlook the bags by not noticing them because they are on the floor, or because they are not attached to the corresponding mattress/bed they are purporting to advertise, or because the bags are lying flat on their back and cannot be seen from a distance.

Some mattress demonstration bags are accidentally misplaced, and are displayed at another proximate mattress/bed display, which does not correspond with the mattress sample inside the demonstration bag, thereby causing confusion to customers and salespersons alike. This displacement can happen very easily, especially when there is high traffic, and many customers are constantly picking up the bags to view them more closely, and they also are a potential lure for children to pick up and play with because their compact size, and transparent nature makes them interesting to look at, hold, and move about.

Therefore, it is desirable to maintain the mattress demonstration bags in such a way so as to allow for ease in viewing, and also to give the salesperson the opportunity, if so desired, to secure the bag to the mattress/bed in order to prevent the bag from being displaced. Sometimes it is better to keep the mattress sample bag on top of the mattress/bed on display, as it is in the most highly visible area, and it will be readily available for customers to view and pick up for inspection. However, in such circumstances, simply laying the bag flat against the mattress does not allow for full display of the sample mattress bag. Whereas, placing the bag in such a way as to be seen from a distance or without having to physically pick it up, such as propped up at an angle is more desirable. However, other times it is better to keep the mattress sample bag fixably secured to the mattress/bed on display in order to prevent displacement of the bags. Nonetheless, the bags should be in a position where customers can view them easily, and be easily accessible to them in case they desire to physically hold the bags for closer inspection.

It is well known to provide an easel on the backs of photo frames to allow for ideal viewing of the picture. Such easels allow for independent stabilization of the picture frame, and obviate the need for separate securing means to keep the frame from falling. Such easels are often molded or secured onto the backs of the picture frames. Thus, allowing for a one-piece configuration.

There are however, easels, which employ more complex configurations, but the goal is the same: to allow for stabilization of the frame, etc . . . that it is supporting. These more complex configurations often include flexible chains to prevent the easel from moving past a certain angle. Or, it may include means for hinging the easel to the frame to allow for various angles of stability; thereby allowing the frame to be angled according to the user's preference. Easels are made from a variety of materials, including composites. Such materials include wood, metal, plastic, cardboard, Styrofoam, and even heavy paper.

There is a need for an easel designed specifically for supporting a mattress demonstration bag, which can provide an improvement over the prior art of easels designed for other purposes such as supporting photo or picture frames or artists' easels, which will furthermore permit dual supporting functions to regulate the manner in which the mattress demonstration bag will be supported.

SUMMARY OF THE INVENTION

The present invention provides a novel easel, which attaches to and provides support for a mattress demonstration bag, and which can be fixably secured to the mattress demonstration bag with pressure sensitive tape. The easel, according to the present invention, is capable of angles of support ranging from 0° to 90°. Moreover, the present invention provides for a strip of vinyl ribbon to join the bottom portion of the easel to the bottom portion of the mattress demonstration bag. The ribbon is sewn into the bottom of the easel on one end, and is attached to the mattress demonstration bag by a circular Velcro pad on the opposite end.

The easel of the present invention comprises a base and a transparent envelope housing, which carries a support board. The support board is in the form of a relatively flexible, or alternatively, a relatively rigid material, and the base is in the form of a collapsible, anti-static, vinyl ribbon fixably sewn into the bottom portion of the housing, and is fixably attached to the bottom portion of the mattress demonstration bag with a Velcro attachment pad. The upper portion of the easel housing is fixably secured to the upper portion of the back of the mattress demonstration bag with a generally elongated strip of pressure sensitive tape.

The envelope housing is constructed of transparent, flexible plastic, and is enclosed on all sides by plastic stitching to encapsulate the support board. The flexible quality of the envelope housing allows for flexion of the easel although it is fixably secured to the back of the mattress demonstration bag with the strip of pressure sensitive tape.

While the envelope housing receives the support board, the support board, preferably, is a separately manufactured element, which is placed into the envelope housing. The envelope portion of the housing is constructed having a pocket-like embodiment. Whereby, the support board slides into the envelope or pocket opening. Moreover, the opening to the envelope is preferably kept in an opening position. However, if so desired, the opening may be closed using fastening means such as tape, stitching, or other fastening means to filly encapsulate the support board. The support board may be dimensioned and configured to fill the entirety of the housing envelope. Preferably, the support board is acutely dimensioned and configured in relation to the space provided in the envelope. Furthermore, the upper portion of the support board may protrude from the opening of the top of the housing envelope, such that the user may maneuver it with ease.

While the base of the easel is attached to the back of the mattress demonstration bag, the flexible quality of the base allows for the easel to move from an angular alignment of 0° to 60°, measured from the back of the mattress demonstration bag. Thus, the maximum angle at which the easel will allow the mattress demonstration bag to be supported is 60° while the base is attached to the bag. However, one unique attribute of the present invention is that the base of the easel can be removed from the back of the mattress demonstration bag by detaching the Velcro attachment pad of the base from the corresponding Velcro attachment pad of the bag. Upon detachment of said base from said bag, the easel is capable of moving from an angular alignment of 0° to 90°, measured from the back of the mattress demonstration bag. In this maximum configuration, the easel is perpendicular to the bag, but remains attached by the elongated strip of pressure sensitive tape located at the upper portion of the easel. Once the easel is in its perpendicular position, then it is capable of being slidably attached in between the mattress and box spring, whereby the mattress demonstration bag hangs from the side (or end) of the bed on display. This, allows the bag to remain attached to the bed on display, and helps prevent displacement of the bag. Furthermore, in this position, the bag is still capable of being fully viewed by customers.

It is an object of the present invention to provide an easel, which is useful for supporting and stabilizing a mattress demonstration bag, which is on display on top of a mattress.

It is another object of the present invention to provide an easel, which includes a flexible, collapsible base, which can be released from engagement with the mattress demonstration bag by the detachment of securing means.

It is another object of the present invention to provide securing means in the form of Velcro pads for detaching and attaching the base from the mattress demonstration bag.

It is another object of the present invention to provide an envelope housing for encapsulating a support board to provide stability for the easel.

It is another object of the present invention to provide a relatively flexible, or alternatively, a relatively rigid support board.

It is another object of the present invention to provide an easel, which can be positioned at an angle between 0° to 90°, such that when the base of the easel is attached to the mattress demonstration bag, the maximum angle of support, which the easel may be positioned at, is 60°.

It is a further object of the present invention to provide an easel, whereby, when the base of the easel is detached from the mattress demonstration bag, the easel is capable of providing an angle of support of 90°, such that the easel becomes a cantilever support for the mattress demonstration bag by slidably attaching in between the mattress and box spring.

It is a further object of the present invention to provide a flexible easel, which is capable of angles of flexion of 0° to 90°.

DETAILED DESCRIPTION OF THE PREFERRED EMBODIMENTS

Figure 1:
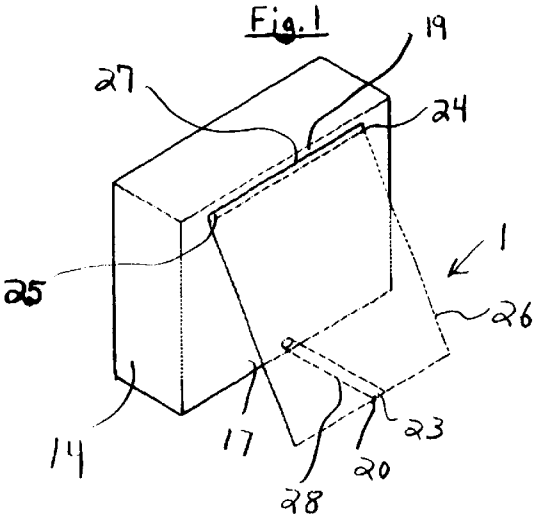
FIG. 1 is a parallel perspective view of an easel for supporting a mattress demonstration bag according to the present invention.
Figure 4:
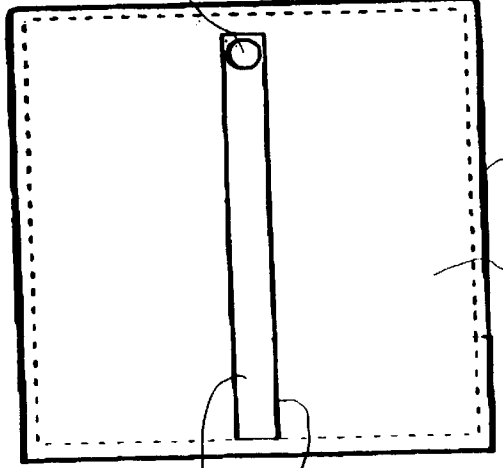
FIG. 4 is back elevation view of the easel of FIG. 1 shown with the base of the easel flush with the housing.
Figure 3:
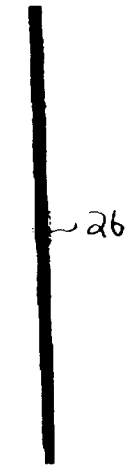
FIG. 3 is a side elevation view of the housing of the easel of FIG. 1.
Figure 2:
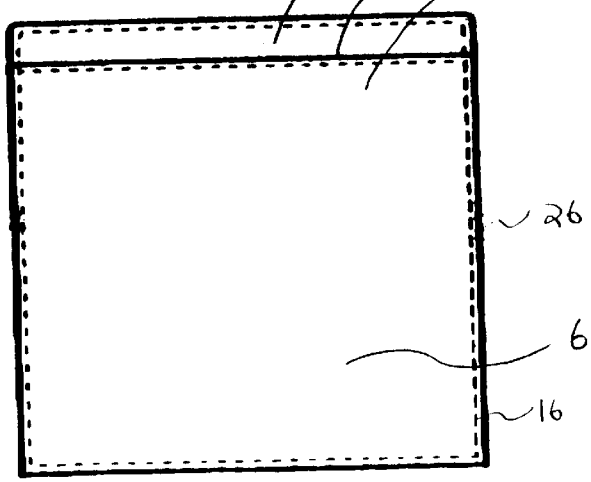
FIG. 2 is a front elevation view of the housing of the easel of FIG. 1 according to the present invention.
Figure 7:
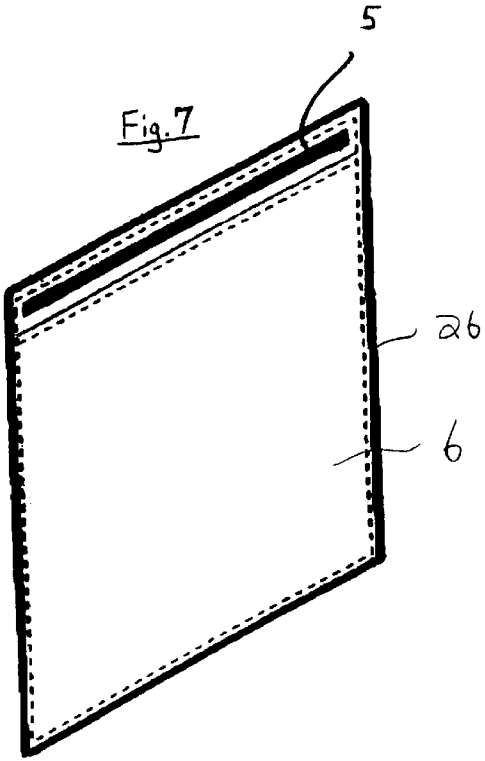
FIG. 7 is a perspective view of the housing of FIG. 2.
Figure 6:
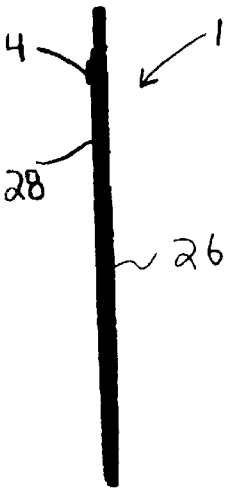
FIG. 6 is a side elevation view of the easel of FIG. 1 shown with the base of the easel flush with the housing.
Figure 5:
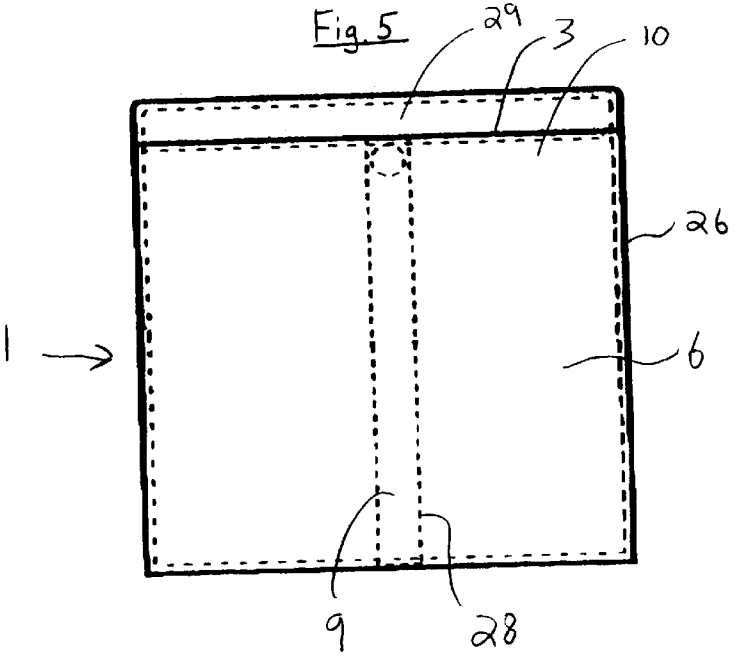
FIG. 5 is a front elevation view of the easel of FIG. 1 shown with the base of the easel flush with the housing, and shown without the pressure sensitive tape.
Figure 9:
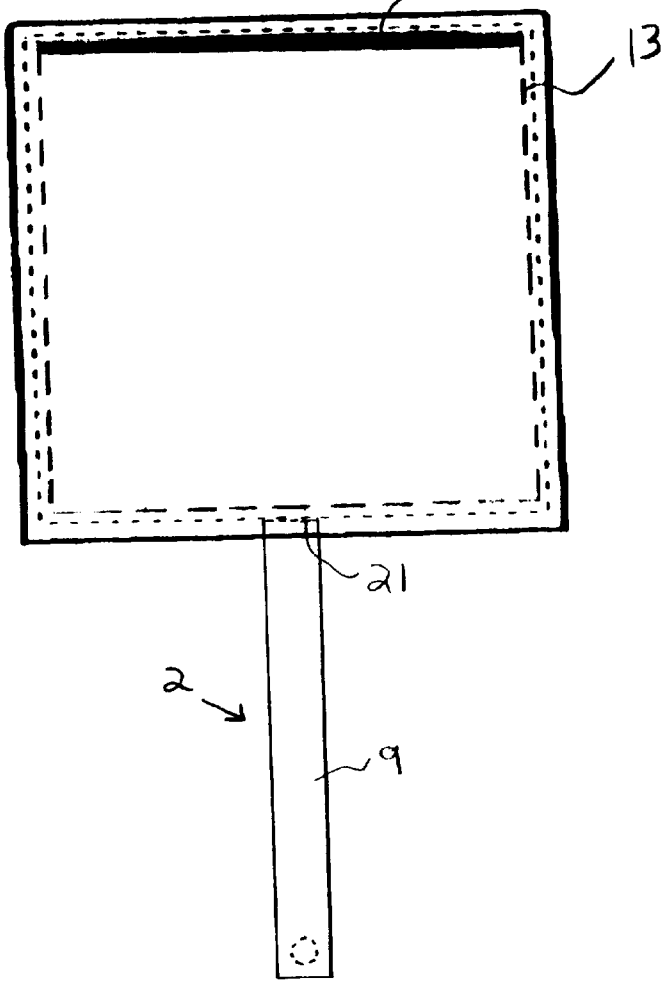
FIG. 9 is an alternate back elevation view of the easel of FIG. 1 shown with the base of the easel hanging from the housing envelope, and unattached to the mattress demonstration bag, and also shown with the support board attached.
Figure 8:
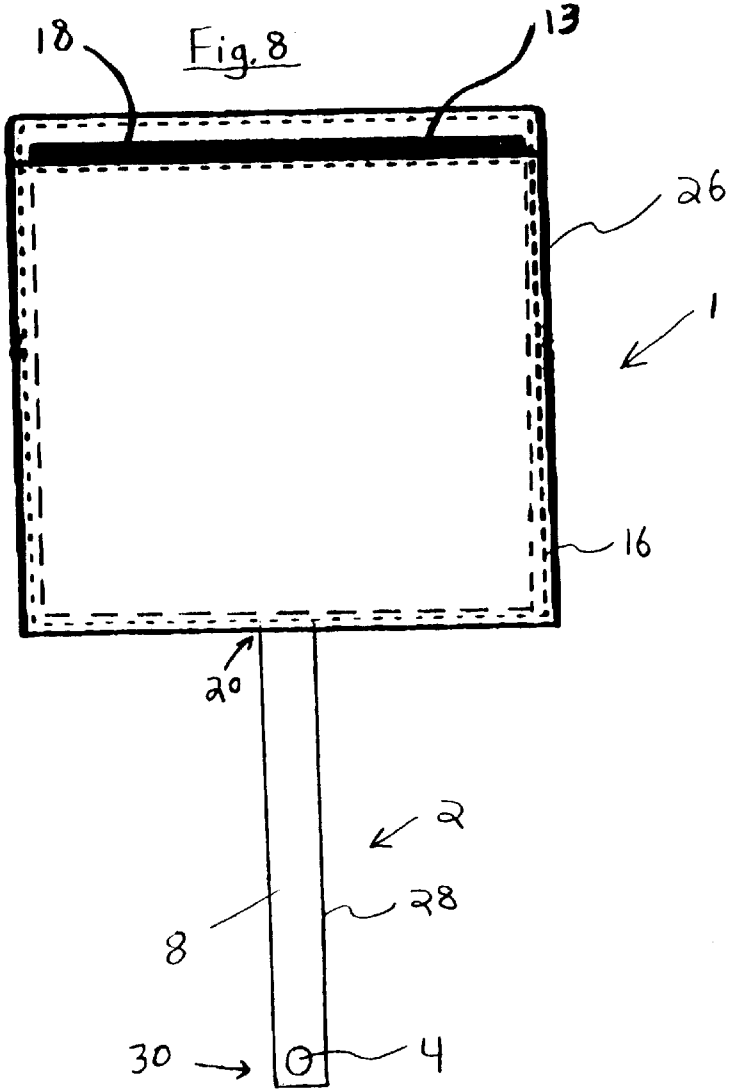
FIG. 8 is an alternate front elevation view of the easel of FIG. 1 shown with the base of the easel hanging from the housing, and unattached to the mattress demonstration bag, and also shown with the support board attached.

Reference now being made to FIGS. 1–10, an easel for supporting a mattress demonstration bag 1 according to the present invention is shown. The easel 1 comprises a housing 26 and a base 2. The housing 26 further comprises an envelope 10, which is mounted on a front wall 29 of the housing 26. The envelope 10 is mounted on the housing 26 by mounting means 16, preferably in the form of plastic stitching. The envelope 10 originates with an envelope opening 3, which is located in an upper portion 25 of the housing 26.

Figure 10:
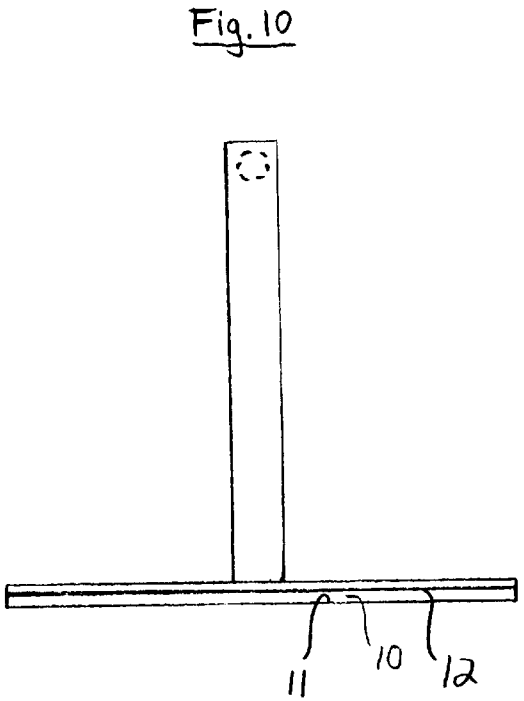
FIG. 10 is a top plan view of the easel of FIG. 1 shown with the base of the easel perpendicular to the housing.

The upper portion 25 of the housing 26 further comprises a flexion portion 24, which allows the housing to articulate from a minimum angle of 0° to a maximum angle of 90° measured from the mattress demonstration bag 14. The housing 26 is mounted on an upper portion 19 of the mattress demonstration bag 14 by mounting means 5, preferably in the form of pressure sensitive tape. The envelope 10 further comprises an inner front wall 11 and an inner rear wall 12, as best seen in FIG. 10. Moreover, the envelope 10 further comprises an outer front wall 6, which is the reverse side of the inner front wall 11. The reverse side of the inner rear wall 12 of the envelope 10 is an outer rear wall 7 of the housing 26. The housing 26 further comprises a bottom middle edge 23 and a top edge 27.

The base 2 is preferably in the form of an anti-static, vinyl, flexible ribbon 28. Said ribbon 28 comprises an upper surface 8, a lower surface 9, a fixed end 20, and a free end 30. The bottom middle edge 23 of the housing 26 is attached to the fixed end 20 of the ribbon 28 by connecting means 21, preferably in the form of plastic stitching, which connects the base 2 to the housing 26. The top edge 27 of the housing 26 connects the pressure sensitive tape 5 to the upper portion 19 of the demonstration bag 14.

A VELCRO pad 4 fixably attached to the free end 30 of the ribbon 28 attaches said base 2 to a corresponding Velcro pad 15 on a lower portion 17 of the mattress demonstration bag 14. Wherein, the VELCRO pads 4, 15 preferably in the form of a traditional "hook and pile" embodiment.

A support board 13 is slidably mounted into the envelope 10 to provide rigidity of the base 2; thus providing stabilization for the easel 1. The support board comprises an upper portion 18, which protrudes from the envelope opening 3 to allow the user to maneuver it easily. The support board 13 is a relatively flexible board made from flexible material such as cloth or vinyl; or alternatively, the support board 13 is preferably a relatively rigid board made from rigid material such as cardboard, Styrofoam, wood, or plastic.

Figure 11:
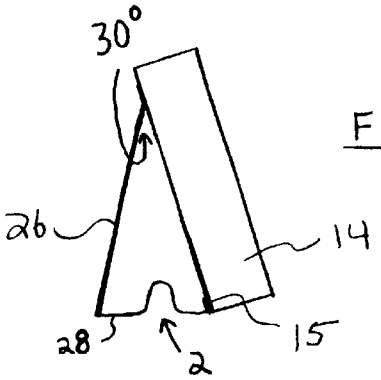
FIG. 11 is a side elevation view of the easel mounted on the mattress demonstration bag shown with the easel at an angle of support of 30°.
Figure 12:
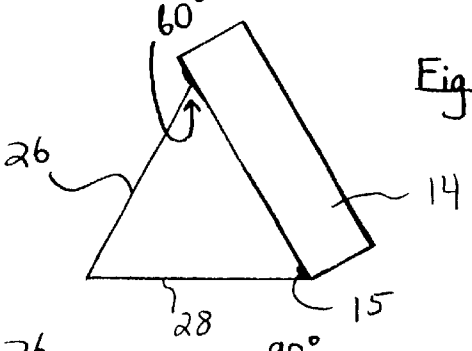
FIG. 12 is a side elevation view of the easel mounted on the mattress demonstration bag shown with the easel at an angle of support of 60°.
Figure 13:
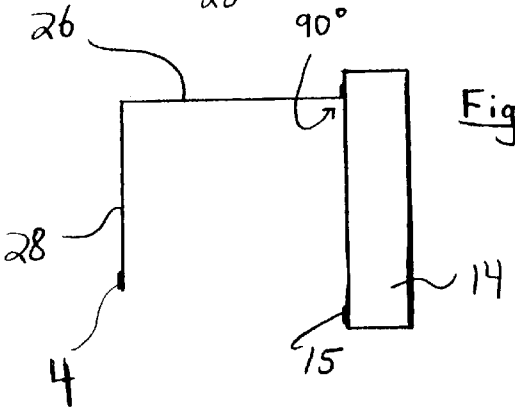
FIG. 13 is a side elevation view of the easel mounted on the mattress demonstration bag shown with the easel at a cantilever position, at an angle of support of 90°, with the base unattached to the mattress demonstration bag.

FIGS. 11–13 show the easel 1 in various stages of manipulation. Specifically, FIG. 11 shows the easel 1 at a 30° angle of support, whereby the base 2, manifested in the embodiment of the ribbon 28, is in a state of flexion, and is collapsed. FIG. 12 shows the easel 1 at an angle of 60°, which is the maximum angle at which the easel 1 will support the mattress demonstration bag 14 while the base 2 is attached to the bag 14. FIG. 13 shows the easel 1 perpendicular to the bag 14, whereby the angle of support is 90°, and the base 2 is no longer attached to the bag 14.

Figure 14:
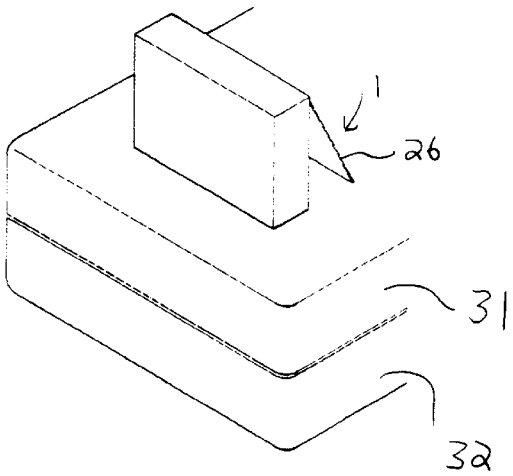
FIG. 14 is a perspective view of the easel attached to the mattress demonstration bag shown in use on top of a mattress.
Figure 15:
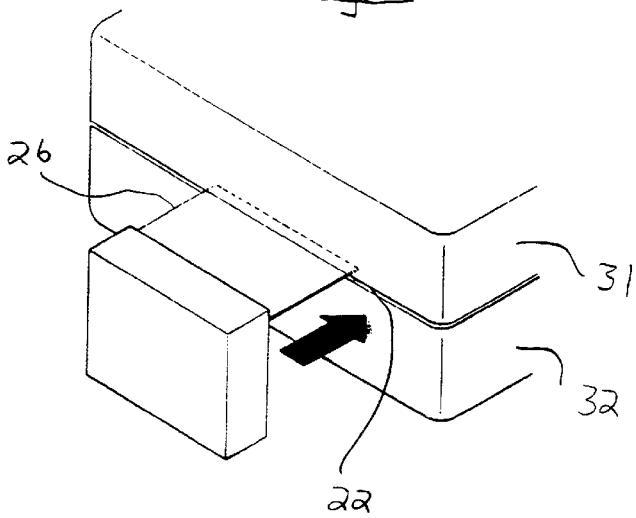
FIG. 15 is a perspective view of the easel attached to the mattress demonstration bag shown in use in between the mattress and box spring.

FIG. 14 shows the mattress demonstration bag 14 with the easel 1 mounted thereon, with the base 2 attached, in use shown on top of a mattress 31. Similarly, FIG. 15 shows the mattress demonstration bag 14 with the easel 1 mounted thereon, with the base 2 unattached, in use being positioned in an opening 22 in between the mattress 31 and a box spring 32. The mattress demonstration bag 14, and sub parts lower portion of bag 17 and upper portion of bag 19, mattress 31, box spring 32, and opening 22 do not constitute claimed elements of the present invention, and are merely referred to for clarity.

These and other advantages of the present invention will be understood by a reading of the Summary of the Invention, the Brief Description of the Drawing Figures and the Detailed Description of the Preferred Embodiments.

What is claimed is:

1. An easel for mounting on and supporting a mattress demonstration bag, wherein said easel comprises a housing, a base, and supporting means; wherein a) said housing further comprises:
   1) an envelope;
   2) means for encapsulating said envelope; and
   3) means for attaching said housing to said mattress demonstration bag;

b) said base further comprises:
   1) means for attaching said base to said housing;
   2) means for attaching said base to said mattress demonstration bag; and
   3) flexible ribbon means attached to said base and selectively attachable to said envelope for articulating said easel at an angle of support of 0° and 90°.

2. The easel of claim 1, wherein said supporting means is flexible.

3. The easel of claim 1, wherein said supporting means is rigid.

4. The easel of claim 1, wherein said means for encapsulating said envelope is stitching, wherein said stitching is plastic.

5. The easel of claim 1, wherein said means for attaching said housing to said mattress demonstration bag comprises pressure sensitive tape.

6. The easel of claim 1, wherein said means for attaching said base to said housing is stitching, wherein said stitching is plastic.

7. The easel of claim 1, wherein said means for attaching said base to said mattress demonstration bag includes a VELCRO pad.

8. The easel of claim 1, wherein said easel slidably mounts in between two external mattresses to provide stabilization of said mattress demonstration bag.

9. An easel for mounting on and supporting a mattress demonstration bag, wherein said easel comprises a housing, a base, and supporting means; wherein c) said housing further comprises:
   1) an envelope;
   2) means for encapsulating said envelope; and
   3) means for attaching said housing to said mattress demonstration bag;

d) said base further comprises:
   1) means for attaching said base to said housing; and
   2) means for attaching said base to said mattress demonstration bag; and wherein said easel articulates between an angle of support of 0° to 90°.

10. The easel of claim 9, wherein said easel is at full articulation at 90° when said base is detached from said mattress demonstration bag.

11. The easel of claim 9, wherein said easel is at full articulation at 60° when said base is attached to said mattress demonstration bag.

12. An easel comprising a housing, a base, and supporting means; wherein a) said housing further comprises:
   1) an envelope;
   2) means for encapsulating said envelope; and
   3) means for attaching said housing to an external member;

b) said base further comprises:
   1) means for attaching said base to said housing; and
   2) means for attaching said base to said external member.

13. An easel for mounting on and supporting a mattress demonstration bags, wherein said easel comprises a housing, a base, and supporting means; wherein a) said housing further comprises:

1) an envelope; wherein said envelope is transparent;

2) means for encapsulating said envelope; wherein said means for encapsulating said envelope is stitching, wherein said stitching is plastic; and 3) means for attaching said housing to said mattress demonstration bag; wherein said means for attaching said housing to said mattress demonstration bag comprises pressure sensitive tape;

b) said base further comprises:

1) means for attaching said base to said housing; wherein said means for attaching said base to said housing is stitching, wherein said stitching is plastic; and 2) means for attaching said base to said mattress demonstration bag; wherein said means for attaching said base to said mattress demonstration bag is a male VELCRO pad; wherein said male VELCRO pad connects with a corresponding female VELCRO pad attached to the mattress demonstration bag;

c) said supporting means comprises a support board; wherein said support board is encapsulated within said envelope;

d) said easel articulates between an angle of support of 0° to 90°; wherein said easel is at full articulation at 60° when said base is attached to said mattress demonstration bag; wherein said easel is at full articulation at 90° when said base is detached from said mattress demonstration bag;

said easel slidably mounts in between two external mattresses to provide stabilization of said mattress demonstration bag.

14. The easel of claim 13, wherein said support board is flexible.

15. The easel of claim 13, wherein said support board is rigid.

* * * * *